United States Patent [19]

Newcomb

[11] Patent Number: 4,496,952

[45] Date of Patent: Jan. 29, 1985

[54] TRAP VERTICAL ANTENNA WITH PARALLEL L-C CIRCUITS FOR BROADBANDING

[76] Inventor: Donald R. Newcomb, Box 356E, Rte. 2, San Marcos, Tex. 78666

[21] Appl. No.: 420,481

[22] Filed: Sep. 20, 1982

[51] Int. Cl.[3] ..... H01Q 9/00; H01Q 5/00

[52] U.S. Cl. ..... 343/722; 343/745

[58] Field of Search ..... 343/722, 723, 729, 745, 343/749, 750, 751, 752, 724, 825–831, 901

[56] References Cited

U.S. PATENT DOCUMENTS

| | | | |
|---|---|---|---|
| 2,898,590 | 8/1959 | Pichitino | 343/722 |
| 3,064,257 | 11/1962 | Guest | 343/802 |
| 3,176,298 | 3/1965 | Nettles | 343/722 |
| 3,653,053 | 3/1972 | St. Vrain et al. | 343/745 |
| 4,259,673 | 3/1981 | Guretzky | 343/825 |

*Primary Examiner*—Eli Lieberman
*Assistant Examiner*—Michael C. Wimer
*Attorney, Agent, or Firm*—Hugh D. Jaeger

[57] ABSTRACT

Plurality of inductor-capacitor parallel L-C circuits for vertical antennas and beam array antennas where each antenna includes a plurality of circuits, each circuit including an inductor-capacitor tube-coil positioned adjacent a trap of said antenna, the tube-coil assembly including an outer metallic tube, a dielectric insulator telescoped therein, an inner metallic tube, a coil connected between an outer and inner tube about the insulator tube, and a clamp assembly including bolts and wing nuts for clamping the inductor-capacitor coil arrangement substantially parallel and upward to the trap of the antenna. The pluralities of inductor-capacitor tube coils are particularly useful with vertical antennas utilizing traps and directional array antennas utilizing traps. Any one or plurality of inductor-capacitor tube-coil configurations can be utilized on either a vertical array or a beam array for expanding the number of frequencies of operation, whether the inductor-capacitor tube-coil assemblies are one or two or more.

6 Claims, 5 Drawing Figures

TRAP VERTICAL ANTENNA WITH PARALLEL L-C CIRCUITS FOR BROADBANDING

BACKGROUND OF THE INVENTION

1. Field of the Invention

The present invention pertains to antennas, including vertical and directional array antennas and, more particularly, pertains to add-on inductor-capacitor tube coil assemblies for expanding the number of frequencies of each antenna.

2. Description of the Prior Art

Prior art antennas have usually utilized traps for operating at different frequencies. In vertical antennas, the prior art has usually utilized traps for 10 meters, 15 meters and 20 meters, while directional arrays have usually utilized traps for 10 meters and 15 meters. While these antennas have been sufficient in the past, the addition of new amateur frequencies in the 10 Mhz, 18 Mhz, and 24 Mhz region has made these antennas particularly ineffective. These antennas have been utilized since 1950 in popularity and, in effect, with the addition of the new WARC bands are ineffective for use on the new frequencies without addition of some type of assemblies.

Prior art assemblies have proved to be inefficient as not only being lossy in energy, but also subject to burn-out based on power considerations.

The prior art has failed to provide for modification or addition of new frequencies to the prior art designs of vertical antennas and directional arrays, thereby making current designs obsolete for usage on the amateur frequencies.

The present invention provides inductor-capacitor tube-coil assemblies positioned below traps for expanding the frequency range of prior art antennas with the teachings applicable to any other frequencies of utilization.

SUMMARY OF THE INVENTION

The general purpose of the present invention is to provide inductor-capacitor tube-coil assemblies including telescoping metallic tubes with a dielectric insulator therebetween, a coil across said telescoping metallic tubes, and a clamp assembly for clamping the assemblies below and substantially adjacent and parallel to traps for expanding frequency range of antennas. The particular assemblies are beneficial to not only amateur but also to commercial and military applications and can be used for transmitting, receiving, and law enforcement purposes.

According to one embodiment of the present invention, there is provided inductor-capacitor tube-coil assemblies positioned below traps on either vertical antennas or directional arrays, each of said assemblies including an outer shorter cylindrical metallic tube, a telescoping tubular dielectric insulator therein, and a second inner telescoping metallic tube member telescoped and engaged within said insulator, a coil about said dielectric insulator tubular member and connected between said inner tube and outer tube, and a clamp assembly including bolts and wing nuts for clamping said outer metallic tubular member to a tubular member adjacent said trap for addition of frequencies based on the electrical length to that inductor-capacitor tube-coil member.

One significant aspect and feature of the present invention is an inductor-capacitor tube-coil assembly which is capable of being electrically manufactured to any specific frequency and for use on any specific antenna, whether the antenna be a vertical antenna, a directional array requiring the assemblies in pairs, or for other types of antennas such as yagis, dipoles, or the like.

Another significant aspect and feature of the present invention is inductor-capacitor tube-coil assemblies suitably usable in the field not requiring complex tools or electrical knowledge to add on to existing structure. The add-on structure can be attached with simple hand tools or may only require the twist of a wing nut for the additional assemblies.

A further significant aspect and feature of the present invention is add-on inductor-capacitor tube-coil assemblies for utilization on current amateur antennas for the addition of the WARC frequencies.

A further object of the present invention is to provide an inductor-capacitor tube-coil assembly for utilization on either vertical antennas or beam antennas and which provide for easy installation as well as modification of existing antenna structures. The teachings of the present invention can be incorporated into newly manufactured antennas or can be utilized as an add-on product for existing antenna structure.

The teachings of the present invention are applicable to any size antenna from 3 Mhz up through the VHF frequencies and beyond as required, dependent of course upon the size of the antenna structure as well as the frequency of operation.

Having thus described the invention, it is the principal object hereof to provide a plurality of inductor-capacitor tube-coil assemblies for either vertical antennas or directional array antennas or the like for expanding and increasing the frequencies of operation of the antenna.

One object of the present invention is to provide at least one or more than one inductor-capacitor tube-coil assemblies for an antenna for expanding the number of frequencies of operation of that antenna. The inductor-capacitor tube-coil assemblies are lossless and provide for expanded frequency coverage of an antenna.

Another object of the present invention is to provide inductor-capacitor tube-coil assemblies which are easily implemented and installed on an antenna with relative ease and provide functional expansion of frequency range.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF PREFERRED EMBODIMENTS

Figure 1:
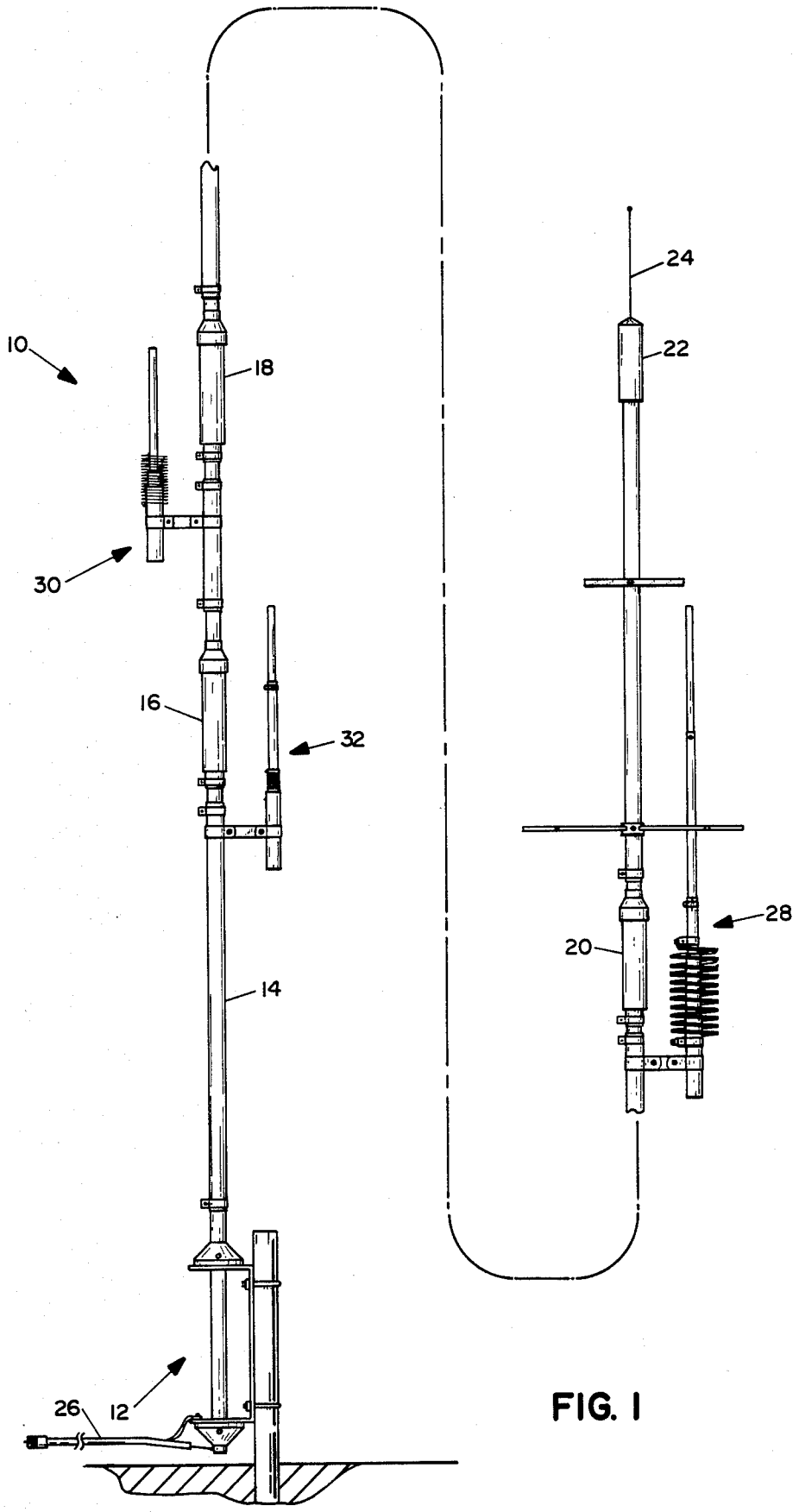
FIG. 1 illustrates a plan view of a vertical antenna with the inductor-capacitor tube-coil assemblies for 10 Mhz, 18 Mhz, and 24 Mhz.

FIG. 1 illustrates a plan view of inductor-capacitor tube-coil assemblies 10 positioned on a vertical antenna 12. Vertical antenna 12 includes a substantially metallic tubular conductor 14 extending upwardly including a 10-meter trap 16, a 15-meter trap 18, a 20-meter trap 20, a 40-meter self-resonant coil or trap 22, and a top-hat loading member 24 with tubular elements therebetween. Coaxial cable 26 connects between the base of the antenna and ground. Elements 14–26 are well known in the art on vertical antennas which have been sold over the past thirty years or so. The antennas are sold by numerous manufacturers and are made for five-band operation on 80 through 10 meters or a lesser number of frequencies, of course including a lesser number of traps. The traps are relatively lossy and are not an ideal electrical or mechanical configuration but yet have existed in the prior art as a "brute force" method of providing a five-band vertical.

A 10 Mhz inductor-capacitor tube-coil assembly 28, an 18 Mhz assembly 30, and a 24 Mhz assembly 32 position below the traps 20, 18 and 16 respectively.

Figure 2:
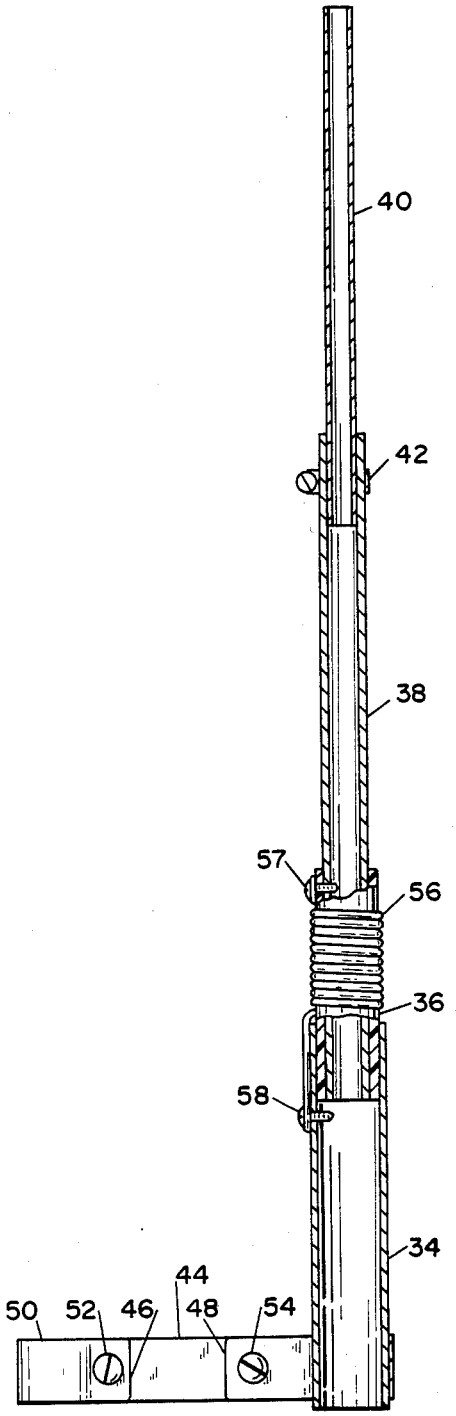
FIG. 2 illustrates a sectional view of the 24 Mhz inductor-capacitor tube-coil assembly taken along line 2—2 of FIG. 1.

FIG. 2 illustrates a sectional view taken along line 2—2 of FIG. 1 illustrating the 24 Mhz assembly as now described in detail. The 24 Mhz assembly is configured of $1\frac{1}{8}$" OD tubing approximately five inches high as element 34, a dielectric member 36 projecting thereinto, $\frac{3}{4}$" tubing 38 telescoped into the insulator 36, and 4/8" tubing 40 telescoped into member 38 and secured thereto with hose clamp 42. Tube 38 is approximately nine inches while tube 40 is approximately eight inches long. The overall height of the 24 Mhz section is approximately 18–20 inches and is secured thereto with a clamp 44 having bent-over portions 46 and 48 for securing at point 50 on the antenna 12 and about the lower end of the tube 34 and is secured with nut-and-bolt assemblies 52 and 54. The nut-and-bolt assemblies can include wing nuts about bolts and the clamp member is a strap 44 with portions bent over and overlapping each other for securing by the bolt assemblies 52 and 54. A coil 56 of suitable gauge wire such as No. 16 gauge where about eleven turns secured and electrically connects between tube 38 and tube 34 with sheetmetal screws 57 and 58 and is wound about the dielectric member 36.

Figure 3:
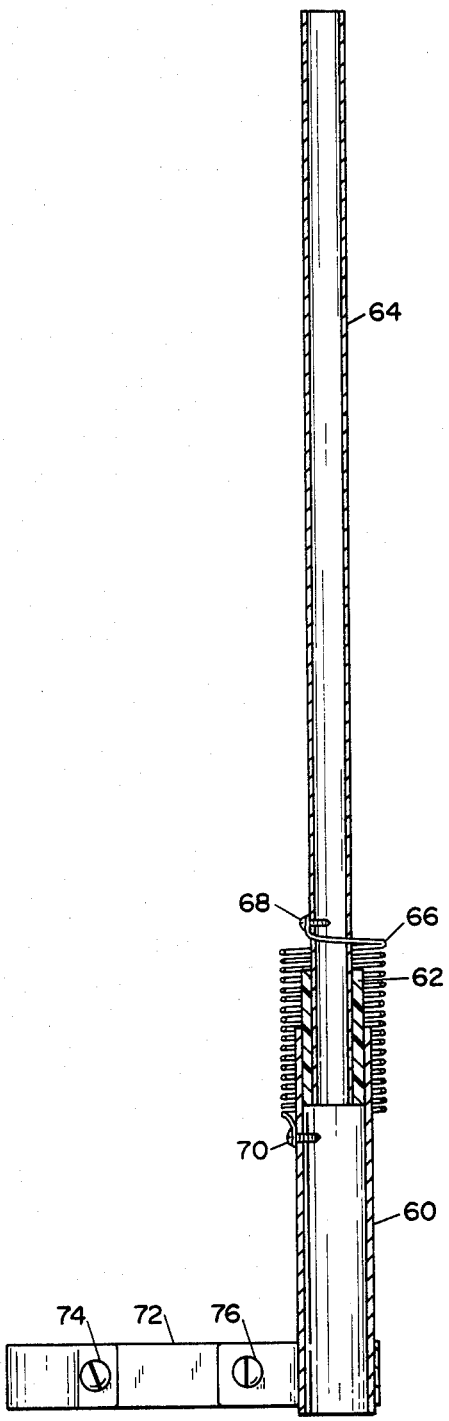
FIG. 3 illustrates a sectional view of the 18 Mhz inductor-capacitor tube-coil assembly taken along line 3—3 of FIG. 1.

FIG. 3 illustrates a sectional view taken along line 3—3 of FIG. 1 showing an outer tube member 60, a dielectric tube member 62, and an inner tube member 64 suitably affixed thereto. A coil 66 secured between sheetmetal screws 68 and 70 encompasses the insulator 62. The member 60 is $1\frac{1}{8}$ OD $2\times5$ inches, the inner tube 64 is $\frac{3}{4}$ OD $2\times13\frac{1}{2}$ inches long. The coil is air wound, approximately $1\frac{1}{2}$ inches in diameter, and 17 turns. By varying the spacing of the turns of the coil, the electrical length of the member can be adjusted. A metal strap 72 including nut-and-bolt assemblies 74 and 76 secures the assembly 30 to the antenna 12 below the trap 18 for 18 Mhz.

Figure 4:
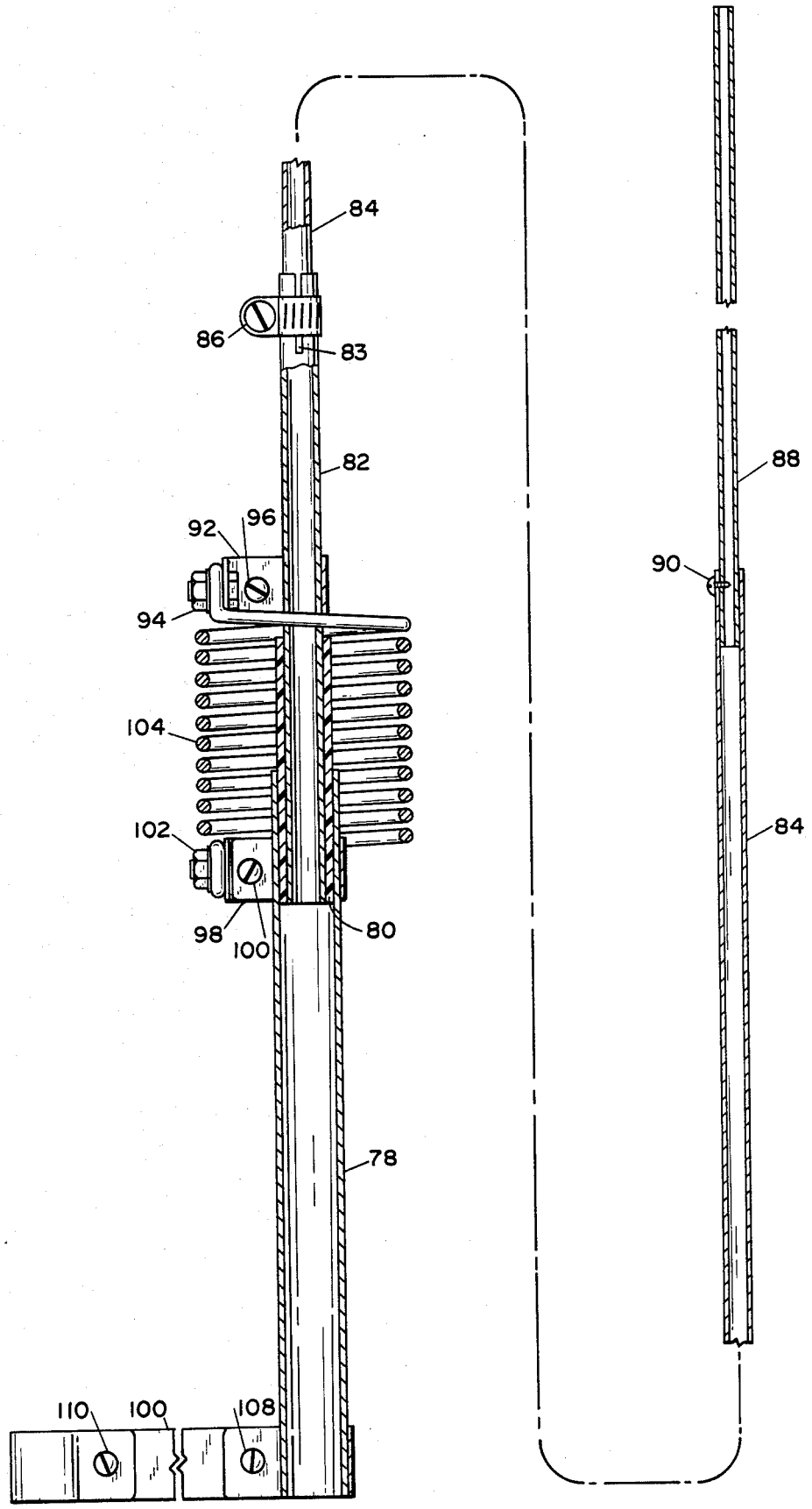
FIG. 4 illustrates a cross-sectional view of the 10 Mhz assembly taken along line 4—4 of FIG. 1; and, FIG. 5 illustrates a plan view of inductor-capacitor tube-coil assemblies on a directional array element having two trap assemblies.

FIG. 4 illustrates a cross-sectional view taken along line 4—4 of FIG. 1 showing the inductor-capacitor tube-coil assembly 28 for 10 Mhz of 15 to 20 inches. From bottom to top, the assembly includes a first outer cylindrical metallic member 78, dielectric insulator 80 telescoped therein, an inner tubular conductor member 82 telescoped within said dielectric insulator 80, an assembly of a first metal tube 84 and a second metal tube 88 telescoped therein secured with a sheetmetal screw 90, the metal tube 80 secured within a slotted tube 82 at slot 83 and secured therewith by hose clamp 86. Two strap assemblies 92 and 98 are secured to members 82 and 78 respectively with nut-and-bolt assemblies 96 and 100, and a coil 104 of aluminum tie wire is secured between the straps with nut-and-bolt assemblies 94 and 102. A strap 100 secures member 78 with nut-and-bolt assembly 108 to below the trap 20 with nut-and-bolt assembly 110.

MODE OF OPERATION

The 10-, 18-, and 24-Mhz traps provide for expanded WARC coverage of a common five-band vertical antenna. The specific SWR is adjusted for the 10 Mhz circuit between members 82 and 84. The coil spacing is adjusted by adjusting the strap 92 on the member 82. The 18 Mhz assembly is also adjusted by the tube members. The 24 Mhz assembly is adjusted by the tubular members 38 and 40 at the slot 43 by the hose clamp 42. Minimum SWR is adjusted on all frequencies with the assemblies 28, 30 and 32 positioned adjacent the bottom of the respective traps and parallel to the traps. The coils lend themselves to #12 copper and potted. The tubing members lend themselves to exact frequency resonance.

The particular embodiments of FIGS. 2–4 are representative of three structures for expanding frequencies of operations of an antenna structure, whether the antenna structure be a vertical antenna or a beam array device. The specific frequencies have been utilized for amateur radio frequencies by way of example and for purposes of illustration only, and are not to be construed as limiting of the present invention. The assemblies of FIGS. 2–4 can also be utilized on other frequencies and are merely dependent upon the length of the outer cylinder, the inner cylinder, and the number of turns of the coil with respect of course to the wire size, etc. Inherently, for higher frequencies, smaller structures would be utilized, especially when approaching the VHF frequencies.

Each add-on assembly is resonant at the next higher frequency (or band) in this instance. Therefore the 10 Mhz coil-capacitor circuit is a trap for 14 Mhz; the 18 Mhz circuit is a trap at 21 Mhz; and, the 24 Mhz circuit is a trap at 28 Mhz. The add-on assembly plus the tubing extension effectively increases the amount of conductor below each original trap causing resonance at a much lower frequency. So in each instance the add-on L-C assembly is a trap tuned to the same ones to which it is parallel.

ALTERNATIVE EMBODIMENT

Figure 5:
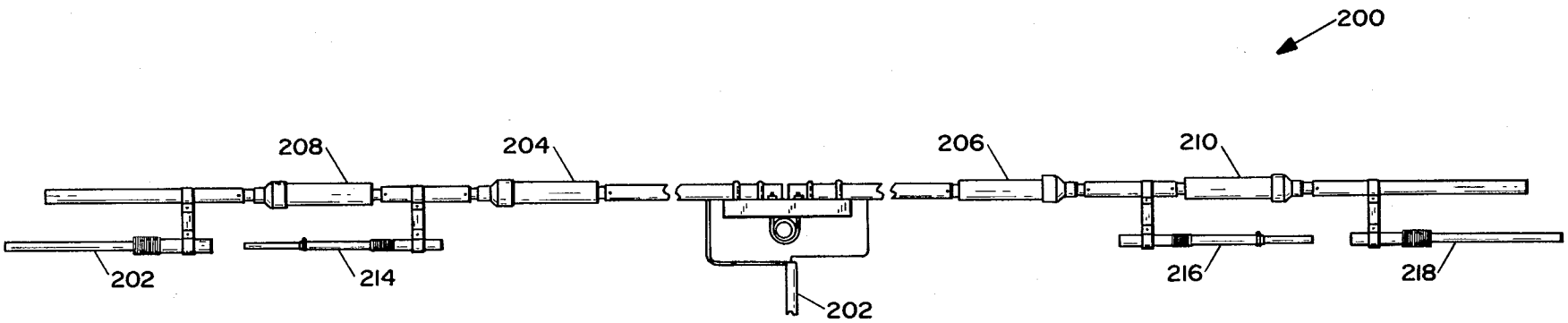

FIG. 5 illustrates a directional antenna element 200 including coaxial feed 202, 10-meter or the like traps 204 and 206 and 15-meter traps 208 and 210. Inductor-capacitor tube-coil assemblies 212, 214, 216 and 218 are positioned substantially below and parallel to each of the trap assemblies for adding of at least two additional frequencies to the directional antenna element. The assemblies 214 and 216 would be utilized to add 24 Mhz to the beam array, while the assemblies 212 and 218 are utilized to add 18 Mhz to the beam array. Depending upon the particular frequencies of a directional array, as well as those frequencies to be added to the directional array, any lesser or greater number of inductor-capacitor tube-coil assemblies can be utilized according to the teachings of the present invention.

Various modifications can be made to the present invention without departing from the apparent scope thereof. The inductor-capacitor tube-coil assemblies can be utilized on any antenna radiating structure and are not limited to the sole embodiments as disclosed herein nor for the sole frequencies disclosed herein.

Having thus described the invention, what is claimed is:

1. Antenna comprising:

a. vertical antenna for 80, 40, 20, 15 and 10 meters including an electrically conducting member and including traps in series for 20, 15, and 10 meters; and, b. inductor-capacitor tube-coil means positioned below each of said traps, each of said inductor-capacitor tube-coil means including first outer cylindrical tube, an inner tubular insulator telescoped therein, and a second inner cylindrical tube telescoped therein, and a coil connected between said outer and inner cylindrical tubes about said tubular insulator, means for adjusting L-C ratio, and clamp means for clamping between a lower portion of each of said traps and a lower portion of each of said outer cylindrical tubular member whereby said tubular inductor-capacitor tube-coil means provides for addition of frequencies to said vertical antenna.

2. Antenna of claim 1 wherein said inductor-capacitor tube-coil means for 10 Mhz includes an additional telescoping inner cylindrical tube telescoped within said second inner tube, said coil being wound of aluminum tie wire, and said inductor-capacitor tube-coil means operational on 30 meters with a height of substantially 15–20 inches.

3. Antenna of claim 1 wherein said inductor-capacitor tube-coil means includes a third inner cylindrical tube telescoped within said second inner cylindrical tube and secured thereto with a hose clamp, said height being substantially 15–20 inches long for operation on 24 Mhz.

4. Antenna of claim 1 wherein said inductor-capacitor tube-coil means is substantially 10–15 inches long for operation on 18 Mhz.

5. Antenna of claim 1 wherein said clamp means comprises a rectangular metal strip bent about a portion of said conducting vertical member and a lower portion of said first outer cylindrical tube, and nut-and-bolt assemblies securing the ends of said strap to a substantially mid-portion of said strap for securing said inductor-capacitor tube-coil means substantially vertical and adjacent to said electrically conducting vertical member.

6. Antenna of claim 1 wherein each of said inductor-capacitor tube-coil means is positioned substantially below and adjacent to each of said vertical antenna traps for 10-meter, 15-meter, and 20-meter.

* * * * *